United States Patent [19]

Blizzard

[11] Patent Number: 4,984,372

[45] Date of Patent: Jan. 15, 1991

[54] RANGE FINDING ARCHERY BOW SIGHT FOR HUNTING

[76] Inventor: C. Andrew Blizzard, Rte. 1, Box 84-A, Trappe, Md. 21673

[21] Appl. No.: 221,364

[22] Filed: Oct. 19, 1988

[51] Int. Cl.[5] ..... F41G 1/467

[52] U.S. Cl. ..... 33/265; 124/87

[58] Field of Search ..... 33/265, 244; 124/87

[56] References Cited

U.S. PATENT DOCUMENTS

| | | | |
|---|---|---|---|
| 2,849,795 | 9/1958 | Vissing | 33/244 |
| 3,136,063 | 6/1964 | Stebbins | 33/265 |
| 3,365,800 | 1/1968 | Carella | 33/265 |
| 3,666,368 | 5/1972 | Sprandel | 33/265 |
| 3,696,517 | 10/1972 | Larson | 33/265 |
| 3,798,783 | 3/1974 | Carella | 33/265 |
| 4,305,208 | 12/1981 | Larson | 33/265 |
| 4,535,544 | 8/1985 | Jones et al. | 33/265 |
| 4,662,347 | 5/1987 | Carlton | 124/87 |
| 4,689,887 | 9/1987 | Colvin | 33/265 |
| 4,785,791 | 11/1988 | Sloop | 124/87 |

*Primary Examiner*—Thomas B. Will

*Attorney, Agent, or Firm*—Richard C. Litman

[57] ABSTRACT

The invention relates, generally, to an improved sighting and range finding device for use with archery bows and the like, and more particularly, to an integrated bow sight comprising a boxed housing having a plurality of horizontal transparent sighting elements therein having "cross hair" sighting references and means for vertical adjustment. An adjustable range finder is mounted atop the bow sight housing so as to provide the user with a correlating means between the range finder and the correct sighting element in order to provide for a more accurate means of sighting, along with the capability of adjusting for different types of game animals.

7 Claims, 4 Drawing Sheets

RANGE FINDING ARCHERY BOW SIGHT FOR HUNTING

FIELD OF THE INVENTION

The present invention relates to archery and bow hunting equipment and like devices, and more particularly, to a range finding bow sight that improves the aiming and shooting accuracy hereof using the apparent size of a target to determine the range of the target, and still further, a range finding bow sight which readily adjusts to compensate for targets having different actual sizes.

BACKGROUND OF THE INVENTION

Generally, it requires years of experience and practice to become proficient at archery, but even with a great deal of practice and experience, accurate shooting often eludes the majority of archers. The difficulty in achieving an accurate shot arises from the many factors that must be coordinated simultaneously. The archer must evaluate the distance to the target, calculate the correct trajectory to compensate for the vertical drop experienced by the projectile while in flight, calculate the proper angle of aim (away from the target) to compensate for any horizontal drifting of the projectile caused by wind, properly draw back the bow string in order to impart a velocity on the projectile so as to strike the target with force, and, most difficult of all, carry out all of the above tasks in succession while utilizing the correct shooting posture and stance.

Achieving accuracy is further complicated while hunting game with a bow and arrow due to problems associated with terrain appearance, lighting, and other shooting conditions. If the hunter is to be successful, it is imperative to quickly make an accurate shot before the game moves out of range or disappears from view altogether.

As a consequence, numerous bow sights have been developed to aid an archer in improving accuracy while increasing his ability to make an accurate shot quickly.

The present invention relates to a range finding bow sight and more particularly, the invention is directed to an improved bow sight use in hunting and target archery.

The invention further relates to an improved bow sight device for hunting wild game and the like comprising an attachable housing having a plurality of window sights which slide therein and which indicate the range of a target according to a predetermined approximated size of an animal.

DESCRIPTION OF THE PRIOR ART

Various prior art bow sight devices and range finder devices, and the like as well as their apparatuses and the method of their construction in general, are known and are found to be exemplary of the U.S. prior art. They are:

| U.S. Pat. No. | Inventor |
|---|---|
| 3,455,027 | Perkins |
| 4,305,208 | Larson |
| 4,617,741 | Bordeaux et al. |

Unlike the above-listed patents, the present invention realizes that while targets of differing actual sizes located at the same distance from the observer all have different apparent sizes corresponding to their actual size, their range from the observer (or archer) remains the same. Consequently, if a plurality of sighting references (whether they be cross hairs, sighting pins, or the like) are arranged upon a bow sight with a one to one correspondence to specific distances (e.g., 10 yards increments) so When a particular sighting reference is oriented to produce the visual illusion of contacting a point located at the distance corresponding to a particular sighting reference, an arrow shot by the archer at this time will pass through a point which is located at a given distance which corresponds to the particular sighting reference regardless of whether the point is located upon a large or small target.

With such a correctly arranged plurality of sighting references on a bow sight, the archer need only know the correct range of the target in order to select the appropriate sighting reference to produce an accurate shot, regardless of the size of the target.

The present invention provides a plurality of unique sighting references which are individually adjustable so as to be correctly arranged in the aforementioned manner. Furthermore, the present invention enables the archer to quickly and easily determine the correct range of a given target (i.e., one of many possible game animals) in order to properly employ the correctly arranged sighting references, regardless of the varying sizes amongst game animals, targets, and the like.

The range finding capabilities of the present invention rely upon the variations of the apparent sizes of various targets with respect to the known actual size of the targets in order to ascertain the correct range therebetween. More particularly, the invention provides the ability to vary the apparent sizes of an array of scaled viewing or framing elements which relate the apparent size of a target to its range. The ability to vary the apparent sizes of the framing elements enables the scaled array to adjust so as to be suitable to determine the range of a variety of different sized targets. The apparent sizes of the array of framing elements may be varied to correspond to the differing apparent sizes of different sized targets as they would appear at the same distances. While the use of apparent size to determine the range of a target is well known and taught in the prior art, none of the prior art teaches a way to systematically vary the apparent size of a scaled reference viewing framework so as to be able to determine the range (at pre-established intervals of distance) of a multiplicity of possible targets of varying individual size.

In U.S. Pat. No. 3,455,027 a collection of sight rings of individually distinct sizes are arranged so that when the apparent size of a particular sight ring matches the apparent size of a target, the use of the particular sight ring to aim the bow will produce an accurate shot. However, the sight rings remain within a fixed plane so that the apparent size of the sight rings remains constant. Therefore, for different targets of varying size, a particular sight ring will correspond to a different range for each target. While one of the sight rings will correspond to a particular range for a certain target, the same sight ring will correspond to shorter range for a target of smaller size and will correspond to a longer range for a larger target. In order use the bow sight for a target of a different size than the target for which the locations of the sight rings were previously set, it is necessary to rearrange the vertical and horizontal location of each of the sight rings so that the new positioning will compensate for the difference in the range that is necessary to cause the apparent sizes of two different sized targets to match the size of one particular sight ring.

Likewise, U.S. Pat. No. 4,305,208 discloses a range finder comprising a vertically elongated aperture with a plurality of crossbars extending horizontally so as to produce a plurality of large framing apertures of varying heights. Both the actual size and the apparent size of the large framing apertures remain constant since the crossbars marking off the individual framing apertures are fixed and the plane in which the apertures are located remains fixed. Consequently, since each target framing aperture is designated for a specific distance, the range finder is limited to applications concerning targets of only one particular size target size being one which has an apparent height equal to the apparent height of any of the target framing apertures when the target is at a distance corresponding to a specific target framing aperture. In other words, at one of the particular distances corresponding to one of the target framing apertures only a target of a certain size will produce an image which correctly fills the target framing aperture.

U.S. Pat. No. 4,617,741 discloses an electronic range finder for archery which has a viewing aperture, or window, with two electronically generated horizontal crossbars. The uppermost of the horizontal crossbars is vertically movable within the window. When a target of known size is viewed through the window and the crossbars are arranged so that the space between the two crossbars is just filled by the image of the target, the range of the target is indicated by a liquid crystal display.

At any particular location, the upper crossbar corresponds to only one particular range the uppermost position corresponding to the closest range, the lowermost position corresponding to the furthest range, and any position therebetween corresponding to a range proportionally in between the upper and lower bounds of the range. The position of the lower crossbar provides a means to vary the height of the space between the two crossbars when the upper crossbar is at any particular chosen position. For different sized targets at the same distance, one position of the lower crossbar Would generate a space between the upper and lower crossbars With an apparent height equal to the apparent height of one of the targets, While a second particular position of the lower crossbar generates a space between the two cross bars which has an image with a height equal to the height of the image of the second target. In other words, for two different sized targets located at the same range, with the upper crossbar in a position corresponding to the range of the targets, the lower crossbar moves in order to change the actual height of the space between the two crossbars so that the apparent size of said space is adjustable.

Using only mechanical means, the present invention varies only the apparent size of the target framing elements by adjusting their distance relative to the eye of the archer (providing the ability to adjust the apparent size of the framing elements to corresponds to an infinite number of distinct sized targets), 4,617,741 relies upon electronic circuitry to generate a target framing element which, at any one particular position of its upper reference line, changes actual size of said framing element so that said apparent size corresponds to the apparent size of a target at the range indicated by the position of upper reference line. Since each position of the lower reference line is generated by an electrical switch and the number of electrical switches are limited (in the embodiment discussed in 4,617,741 there are only four switches), the number of different targets of different size which the device can be used for is limited to the number of switches (i.e., the device is only able to determine the range of targets of four particular sizes). Furthermore, while the device of 4,617,741 also manages to determine the range of different sized targets by varying the apparent size of the target framing elements(s)—although by different means, the reliance of the device upon electronics in order to accomplish this objective makes the device less ideal for hunting. Since hunting is usually performed in wilderness areas, the dependence of the device upon an electrical power source (i.e., a battery) is undesirable. The device becomes vulnerable to failure since the power source may fail. If the power source should fail while hunting in the wilderness, the device of 4,617,741 would become useless. Furthermore, electronics are more susceptible to damage or malfunction when exposed to the elements (moisture, heat, etc.). On the other hand the present invention is independent of any power requirements, thus making it very suitable for hunting in wilderness conditions (particularly when hunting in the wilderness for extended periods of time).

Other U.S. patents which are known and which relate to archery bow sights in general are the following U.S. Pat. Nos. 3,120,222, 3,365,800, 3,798,783, 3,811,195, 4,170,071, 4,328,625, 4,481,717, 4,495,705, 4,535,747, 4,662,347, 4,669,194, 4,689,887, 4,704,800. These patents teach the art of bow sights, range finders, and the like, but non disclose the principle features of the present invention with respect to transparent sliding sight plates and bow sight adjusting means which compensates for different species of game.

SUMMARY OF THE INVENTION

Accordingly, it is an object of the present invention to provide an improved bow sight with target range finding abilities for a number of different sized targets.

It is another object of the present invention to provide means to easily and quickly adjust the range finding portion of the invention to account for different species of game.

Still another object of the present invention is to provide means to easily adjust the mounting of the bow sight on the bow so that the eye to bow sight distance remains constant when the bow with bow sight is used by different archers with different physical dimensions (i.e., different arm lengths).

It is a further object of the present invention to provide a plurality of sighting elements with adjustable vertical and horizontal positioning.

It is still a further object of the present invention to provide a plurality of sighting elements which are encased in a housing so that they are protected form damage.

It is another object of the present invention to provide each of the sighting elements with a sighting reference which is easily discernible in ambient lighting conditions.

Additionally, it is an object of the present invention to provide means to reduce glare seen by an archer when looking through the sight by utilizing polarized elements.

These, together With other objects and advantages of the invention reside in the details of the process and the operation thereof, as is described and claimed more fully hereinafter. References are made to drawings forming a part hereof, wherein like numerals refer to like parts throughout.

DESCRIPTION OF THE PREFERRED EMBODIMENT

Figure 1:
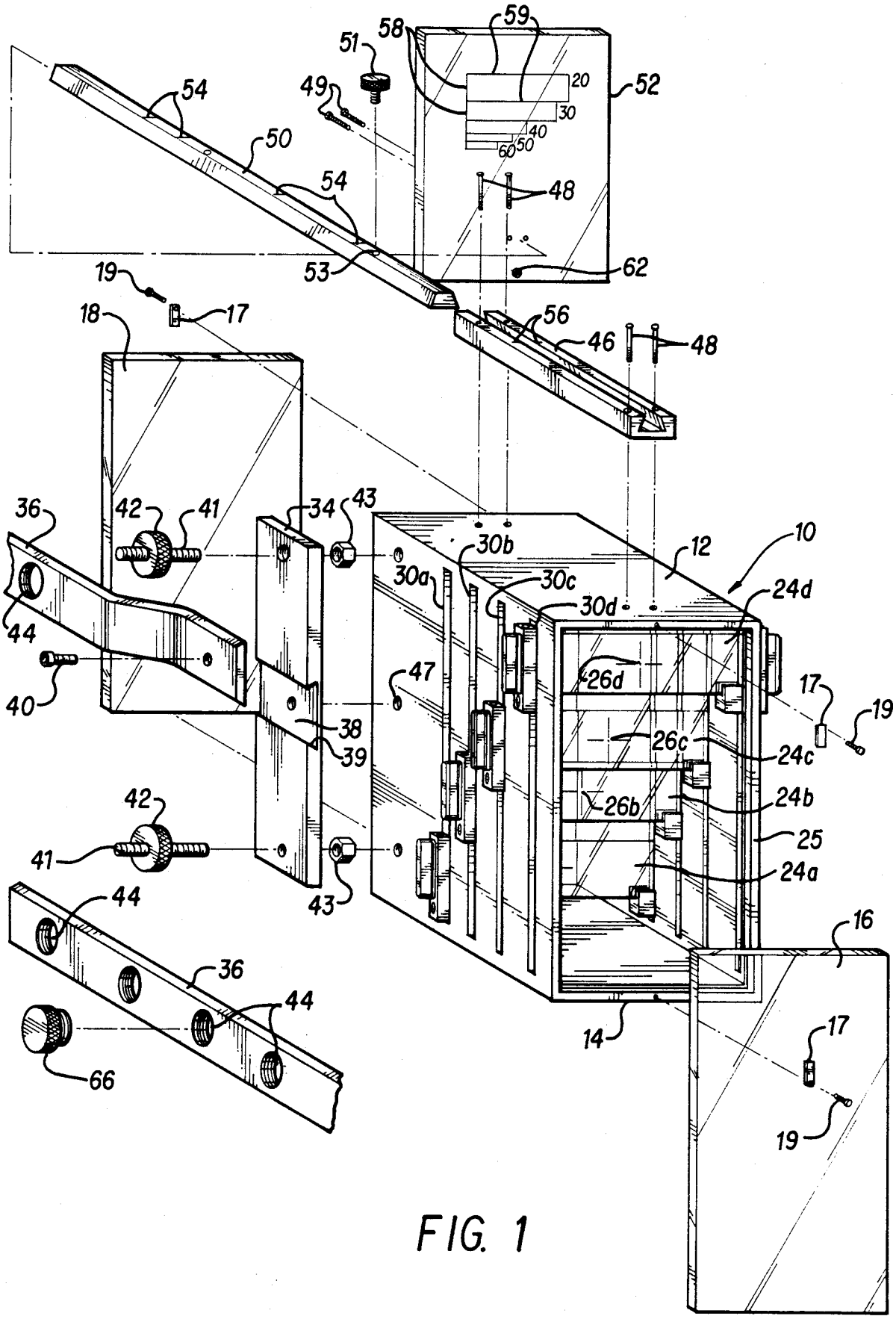
FIG. 1 is a partially exploded perspective view of the range finding archery bow sight.
Figure 2:
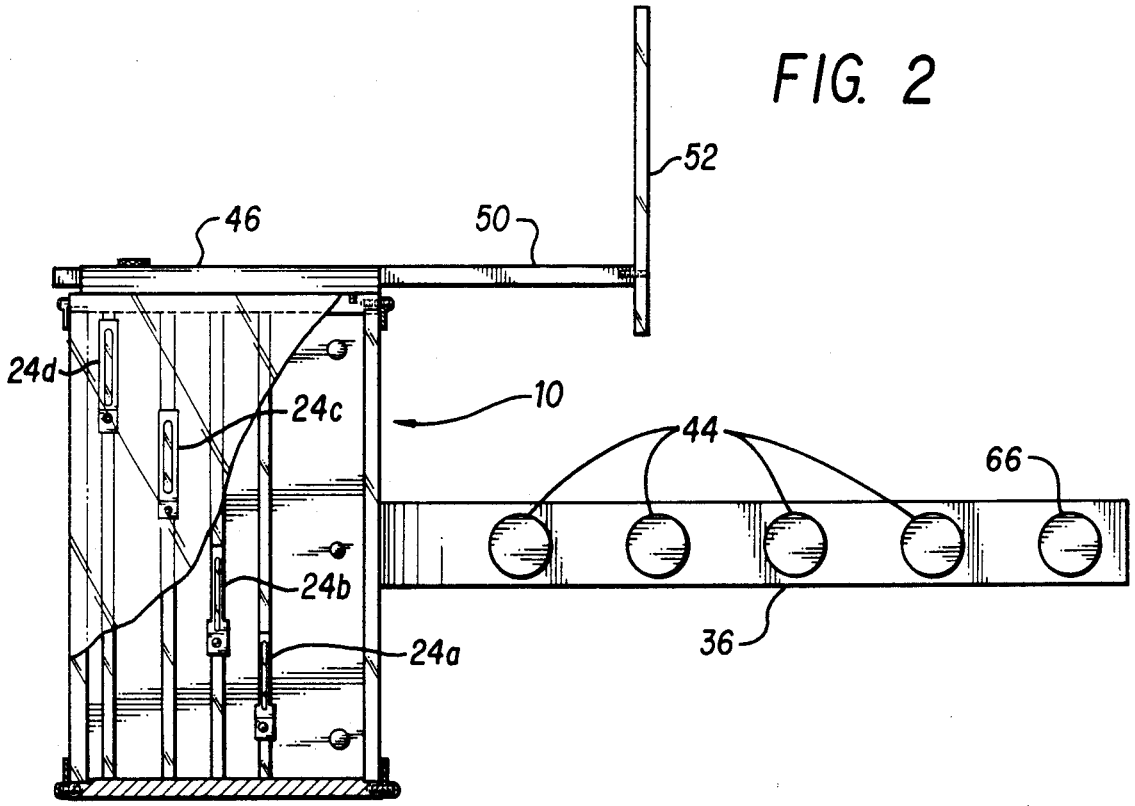
FIG. 2 is a partially sectioned side view of the range finding archery bow sight.
Figure 3:
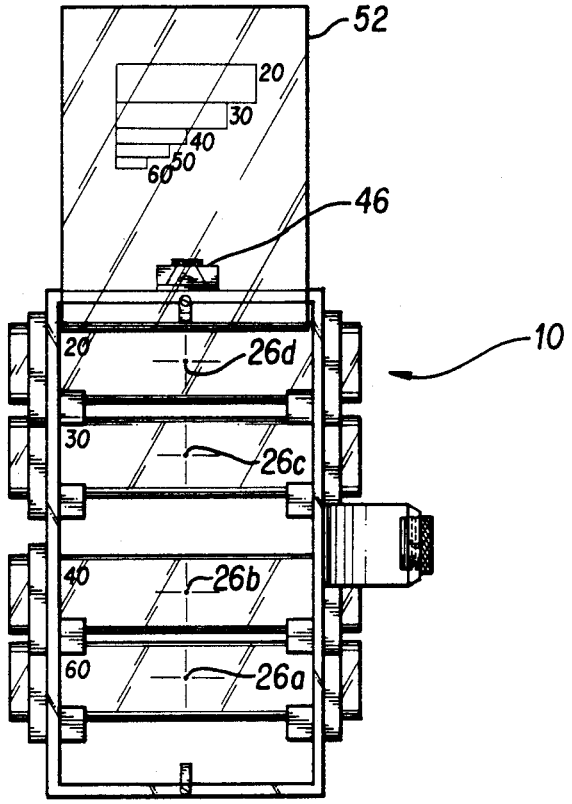
FIG. 3 is a rear view of the present invention as it would be seen when looking therethrough to sight a target.
Figure 4:
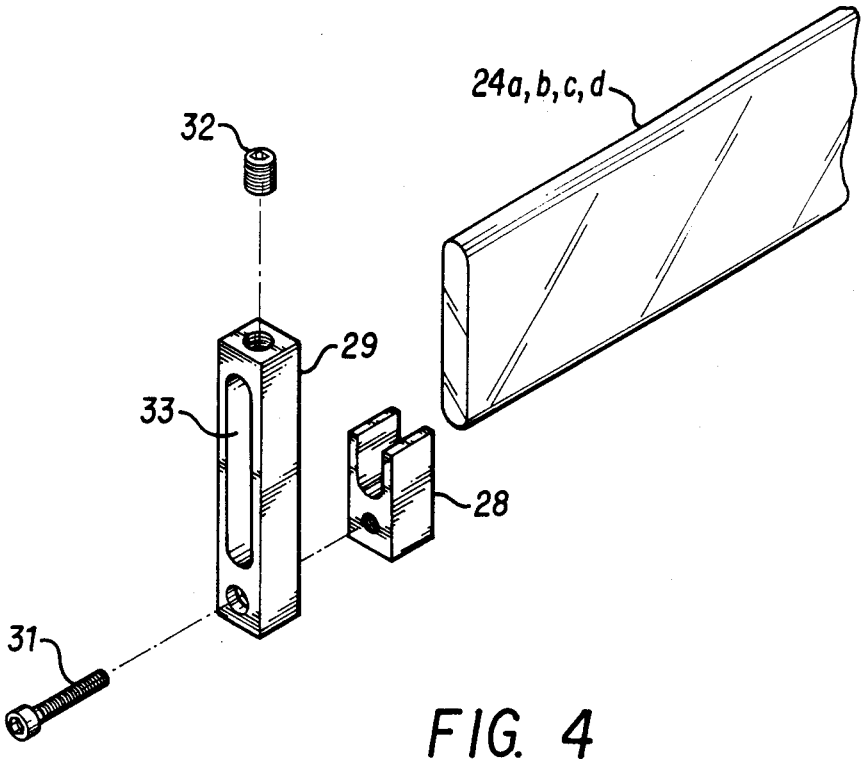
FIG. 4 is a auxiliary view detailing one of the mechanisms for adjustably securing the sighting plate within the housing of the bow sight.
Figure 5:
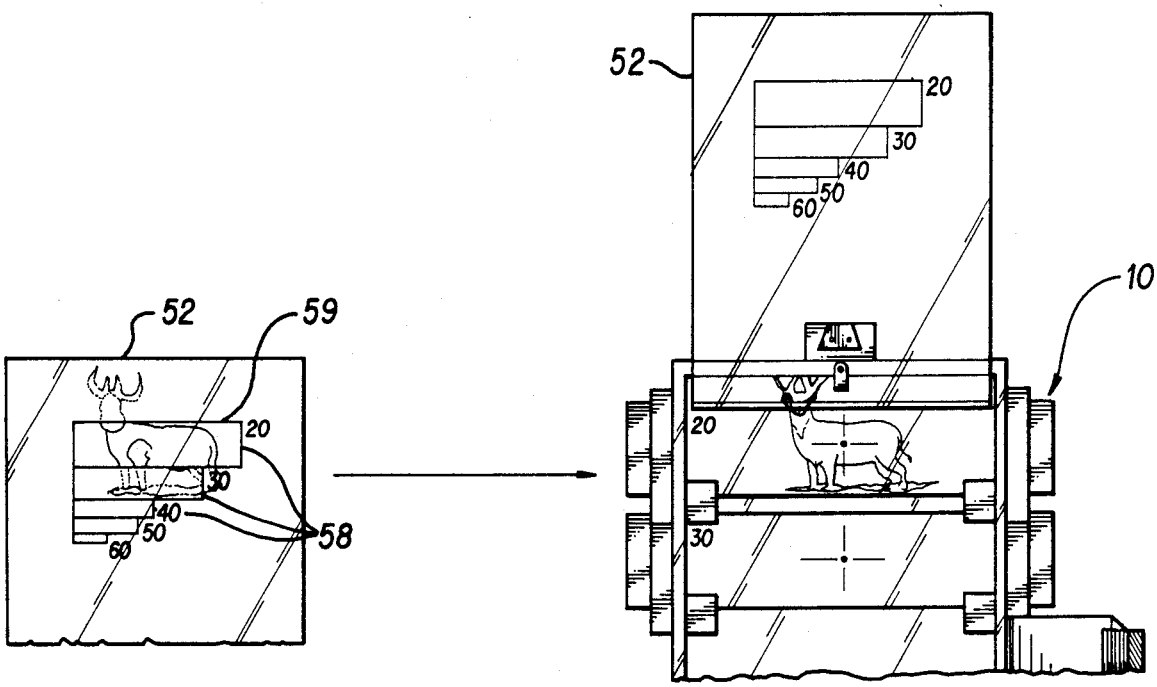
FIG. 5 is a partial rear plan view illustrating the sequence of operation where the range finding portion of the present invention is used to determine the proper sighting reference to employ in order to produce an accurate shot.

In FIG. 1 is described in general a box housing 10 including two sidewalls 20,22, a top portion 12 and a bottom portion 14. There are front and rear transparent panels 16 and 18 which are fastened to box housing 10 by screws 19 and clips 17 and which are of polarizing material or amber-colored material to eliminate glare to a viewer's eyes. The box housing 10 sidewalls 20,22 support a plurality of sighting windows **24*a*, 24*b*, 24*c*, 24*d* each having intersecting reticles 26*a*, 26*b*, 26*c*, 26*d* providing a sighting point. There are cradle elements 28, FIG. 4, for adjustably securing the sighting windows in corresponding elongated supporting slots 30*a*, 30*b*, 30*c*, 30*d*. Cradle elements 28 are supported on the rims beside the elongated supporting slots 30*a*, 30*b*, 30*c* and 30*d*. Clamping members 29 engage the supporting member and cradle element. Screws 31 press the cradle elements 28 against the rim of the supporting slot (30*a*, 30*b*, 30*c*, 30*d*) and toward the clamping members 29 as partially illustrated in FIG. 4 where the slot is not shown. Allen head screw fitting 32 holds the sighting window (24*a*, 24*b*, 24*c*, 24*d*) clamped to the clamping member 29. The clamping member 29 has oblong aperture 33 to receive the sighting window (24*a*, 24*b*, 24*c*, 24*d*). The elements of FIG. 4** constitute the retaining and adjusting means for each sight window when used in cooperation with the rim of the vertical slots of the sidewalls.

In FIG. 1 is shown a vertically positioned retaining bracket 34 oriented to hold a horizontal mounting arm 36 held in a groove 38 with beveled walls 39 restricting within the channel 38 the horizontal arm 36. Screw 40 restrains the arm 36 from sliding in the channel 38 and also indexes to a hole 47 in the box 10. Knurled thumbnuts 42 at the extremes of the vertically oriented and positioned retaining bracket 34 working with the nonrotating studs 41 and locknuts 43 maintain the mounting arm 36 positioned on the box 10. Along the mounting arm 36 are incrementally adjusting apertures 44 to attach to a fixture (not shown) fastened to the bow 64 by knurled bolt 66 to keep this sighting apparatus a constant distance from the eye to compensate for the individual draw length of a particular archer.

An important aspect of this invention is the range finding apparatus attached to the device which When properly manipulated can be used in conjunction with the box housing to better orient the bow With arrow to obtain the trajectory necessary to penetrate the target. The top portion 12 of the box housing 10 has a channel 46 with a dovetailed cross-sectional groove fastened to the top portion 12 by a set of four screws 48. A bar 50 complementary to the dovetail cross-section is inserted into the dovetail groove and locked thereto by the thumbscrew 51 working, through the threaded hole 53, against the channel 46. There is a transparent range finding viewing element 52 with two screws 49 in the end of the bar to hold orientation of the viewing element 52. Scored markings 54 are located intermittently along the bar and a score line 56 is located by the rim of the dovetail groove of the channel 46 on the top portion of the box housing 10. (The view finding element 52 in the exploded diagram of FIG. 1 is shown 180 degrees reversed about a vertical axis taken through the bar from its normal operational orientation for clarity of the numerical indexes of the face of the transparent view finding element 52.)

MODE OF OPERATION

When a game animal is spotted it is identified as to species and the score line related to that species on the bar is made collinear with the score line 56 on the channel 46 on the top portion 12 of the box housing 10. The statistical norm of sizes of a particular species being known, if an increment of linear dimension is marked off on the view finding element or is etched off or otherwise noted as are the 20, 30, 40, 50, and 60 yard increments of FIG. 1, the distance away to the animal target can be approximately known by aligning the anterior and posterior of the animal with the vertical etched lines 58 for a calibrated distance. Or alternatively the horizontal etches line 59 may be sighted to meet the dorsal extreme of the head to bottommost foot portion of the animal target. For a particular species this is a normal size and so the above score lines properly aligned for the species can approximate the range of the target animal by aligning horizontal or vertical etchings with the animal. Now, for a given range the corresponding sighting window (**24*a*, 24*b*, 24*c*, 24*d*) can be vertically set so that the orientation of the box housing 10 makes the dot marking 62 on the view finder and the intersection of the cross hairs of the sighting window coincident. The attached bow will then make the arrow (not shown) assume a trajectory When shot that hits the target held within the sight of the cross hairs. The sighting windows can be set for the individual user of the bow and arrow by vertically adjusting the sight window cradle elements 28 up and down and set their position by tightening the screws 31 when the bow is used for known target distances. This is done by merely noting the orientation of the bow when the target is struck for each user of the bow at known distance to the target and setting the appropriate sight Window (24*a*, 24*b*, 24*c*, 24*d***).

I claim:

1. An archery bow sight comprising;

a box housing having two sidewalls and having removable transparent front and rear panels;

a plurality of sighting windows disposed within said box housing parallel to said front and rear panels, each of said windows having intersecting reticles providing a first sighting point;

means for retaining and vertically adjusting each said sighting windows within said box housing sidewalls;

a transparent range finding viewing element having a plurality of pairs of vertical etched lines, and a plurality of pairs of horizontal etched lines depicted thereon for estimating the range of an animal;

a dot marking depicted on said viewing element, providing a second sighting point to be visually aligned with one of said first sighting points for aiming;

means for adjustably holding said transparent range finding viewing elemental parallel to said box housing; and means for attaching said box housing to an archery bow.

2. An archery bow sight according to claim 1, wherein;

said means for retaining and adjusting said sighting windows include a plurality of laterally adjacent vertical elongated supporting slots in the two sidewalls of said box housing for receiving said windows;

clamping members, each having an oblong aperture to receive one of said windows exteriorly of said box housing, and each having a fastener carried by said clamping member and operable to lock said sighting window to said clamping members, cradle elements engageable with each said window interiorly of said box housing, and fixing means engageable with each said clamping member and cradle element; and said clamping members and cradle elements having a width greater than said elongated supporting slots.

3. An archery bow sight apparatus according to claim 1, wherein;

at least one said front and rear transparent panels is polarized to decrease the amount of glare to a viewer's eyes.

4. An archery bow sight apparatus according to claim 1, wherein;

at least one said front and rear transparent panel is amber colored to decrease the amount of glare to a viewer's eyes.

5. An archery bow sight apparatus according to claim 1, wherein;

said pairs of etched vertical and horizontal lines are arranged so as to provide range finding capabilities utilizing angular measurements from hind end to chest end of a game animal and from top of back to belly of said game animal in order to find approximate distances between the animal and the archery bow sight.

6. An archery bow sight according to claim 1, wherein said means for adjustably holding said transparent range finding viewing element parallel to said box housing further includes:

a horizontal bar normally affixed to said viewing element, said bar slidingly engaging a channel affixed to a top portion of said box housing;

said bar also having scored markings thereon corresponding to various sized game animals, and said channel having a score line coincidable with said scored markings, and a clamping means for positioning said bar relative to said channel, whereby said viewing element may be held at various distances from said box housing for targeting various sized animals, the scored markings being calibrated for particular animals when coincident with the score line.

7. An archery bow sight according to claim 1, wherein said means for attaching said box housing to said archery bow further includes;

an adjustable mounting arm, one end of said mounting arm attached to the archery bow, the other end of said mounting arm attached to a vertically positioned grooved retaining bracket, and said retaining bracket adjustably attached to said box housing;

whereby said bow sight can be positioned to keep it at a constant distance from the eye to compensate for the draw length of a particular archer.

* * * * *